US009896950B2

(12) United States Patent
Willer et al.

(10) Patent No.: US 9,896,950 B2
(45) Date of Patent: Feb. 20, 2018

(54) TURBINE GUIDE WHEEL

(71) Applicant: Rolls-Royce Deutschland Ltd & Co KG, Blankenfelde-Mahlow (DE)

(72) Inventors: Lars Willer, Berlin (DE); Knut Lehmann, Berlin (DE); Philipp Amtsfeld, Berlin (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 489 days.

(21) Appl. No.: 14/479,978

(22) Filed: Sep. 8, 2014

(65) Prior Publication Data

US 2015/0071777 A1 Mar. 12, 2015

(30) Foreign Application Priority Data

Sep. 9, 2013 (DE) ..... 10 2013 217 997

(51) Int. Cl.
*F01D 9/04* (2006.01)
*F01D 5/14* (2006.01)

(52) U.S. Cl.
CPC ..... *F01D 9/041* (2013.01); *F01D 5/141* (2013.01); *F05D 2240/122* (2013.01);
(Continued)

(58) Field of Classification Search
CPC .... F01D 9/041; F01D 5/141; F05D 2240/122; F05D 2240/123; F05D 2240/304;
(Continued)

(56) References Cited

U.S. PATENT DOCUMENTS 2,169,234 A * 8/1939 Ponomareff ..... F04D 25/04 415/207
2,831,653 A * 4/1958 Alford ..... F01D 5/085 415/175

(Continued)

FOREIGN PATENT DOCUMENTS

DE 10054244 6/2002
DE 102004009696 8/2005

(Continued)

OTHER PUBLICATIONS

European Search Report dated Mar. 27, 2015 for related European Application No. 14184094.2.

(Continued)

*Primary Examiner* — Kenneth Bomberg
*Assistant Examiner* — Brian Delrue
(74) *Attorney, Agent, or Firm* — Shuttleworth & Ingersoll, PLC; Timothy J. Klima

(57) ABSTRACT

A turbine stator wheel of a gas turbine with a plurality of stator vanes spaced apart around the circumference is provided. Two adjacent stator vanes form a passage each between the suction side of the one stator vane and the pressure side of the other stator vane starting from the vane trailing edge, which includes a constant passage portion in which the passage has a substantially constant passage cross-section. The constant passage portion has an inlet area and an outlet area. Each stator vane forms on the pressure side a rear area that extends, starting from the vane trailing edge adjoining the constant passage portion as far as the inlet area of the passage portion, and on the pressure-side forms a front area that extends upstream of the rear area. Each stator vane has on the pressure side a convex pressure-side contour.

12 Claims, 6 Drawing Sheets

(52) U.S. Cl.
CPC .. *F05D 2240/123* (2013.01); *F05D 2240/304* (2013.01); *F05D 2240/305* (2013.01); *F05D 2250/711* (2013.01); *F05D 2250/713* (2013.01)

(58) Field of Classification Search
CPC ..... F05D 2240/305; F05D 2250/711; F05D 2250/713
USPC ..... 415/191
See application file for complete search history.

(56) References Cited

U.S. PATENT DOCUMENTS 3,302,397 A * 2/1967 Vlastimir ..... F02C 7/08 415/115
3,475,108 A * 10/1969 Walemar ..... F01D 5/141 415/194
5,562,405 A * 10/1996 Ryall ..... F04D 19/028 415/199.3
6,241,467 B1 * 6/2001 Zelesky ..... F01D 5/187 415/115
6,254,333 B1 * 7/2001 Merry ..... F01D 5/187 29/889.2
6,358,012 B1 3/2002 Staubach
6,491,493 B1 12/2002 Watanabe et al.
6,638,021 B2 * 10/2003 Olhofer ..... F01D 5/141 416/223 A
7,597,544 B2 * 10/2009 Hasenjager ..... F01D 5/141 416/242
7,685,713 B2 * 3/2010 McKeever ..... G06F 17/5095 29/889
8,403,626 B2 * 3/2013 Hasselqvist ..... F01D 5/143 415/91
8,807,930 B2 * 8/2014 Green ..... F01D 5/141 415/191
9,011,081 B2 * 4/2015 Gomez ..... F01D 5/141 415/151
2002/0085918 A1 7/2002 Olhofer et al.
2002/0172594 A1 11/2002 Segawa et al.
2005/0079060 A1 * 4/2005 MacManus ..... F01D 5/141 416/235
2006/0275134 A1 * 12/2006 Hasenjager ..... F01D 5/141 416/237
2007/0086891 A1 4/2007 Nomura et al.
2008/0267772 A1 10/2008 Harvey et al.
2009/0010765 A1 * 1/2009 Propheter-Hinckley ..... F01D 5/147 416/97 R
2012/0051900 A1 * 3/2012 Clements ..... F01D 9/04 415/208.2
2012/0128480 A1 5/2012 Gomez et al.
2013/0124487 A1 * 5/2013 Anglin ..... G06F 3/0641 707/692

FOREIGN PATENT DOCUMENTS

DE 102004009696 B3 * 8/2005 ..... F01D 5/141
DE 102005025213 12/2006
DE 102009036406 2/2011
EP 1496202 A1 * 1/2005 ..... F01D 5/141
EP 1522679 4/2005
WO 2012007716 1/2012

OTHER PUBLICATIONS

German Search Report dated Mar. 18, 2014 from counterpart German App No. 10 2013 217 997.9.

* cited by examiner

Prior Art

Invention

TURBINE GUIDE WHEEL

CROSS-REFERENCE TO RELATED APPLICATION

This application claims priority to German Patent Application No. 10 2013 217 997.9 filed on Sep. 9, 2013, the entirety of which is incorporated by reference herein.

BACKGROUND

This invention relates to a turbine stator wheel, in particular to a high-pressure turbine stator wheel of a gas turbine, especially for being used with a gas-turbine engine.

It is known from the state of the art that the stator vanes of a turbine stator wheel in particular must be designed according to aerodynamic requirements. The contouring of the vane cross-section on the suction side and on the pressure side plays a major role here, but also important is the design of the vane passage between adjacent stator vanes, since the available flow cross-section through the passage partly determines the efficiency of the stator wheel.

The aerodynamic design must however take particular account of ensuring the burn-back capability of the stator vanes of the stator wheel. The burn-back capability of the stator wheel must be understood in this connection as the characteristic that during operation of the gas turbine the trailing edge in particular of the first stator wheel of the high-pressure turbine can burn off under the extreme thermal loads occurring. This means that the stator vane, starting from the vane trailing edge, is shortened by the burn-back. Since the first stator wheel of a high-pressure turbine mainly determines the flow rate through the entire turbomachine, maintenance of the flow rate (capacity) of the first stator wheel is of crucial importance so that the entire turbomachine and all individual components can continue to operate with a nominal mass flow at the design point. It is thus necessary that the flow rate (capacity) of the turbine does not substantially change due to the burn-back.

To ensure the burn-back criterion of a turbine stator wheel, the passage cross-section inside the stator wheel upstream of the narrow cross-section (i.e. in the direction of the progressing burn-back of the vane trailing edge) must remain approximately constant, so that even in the case of burn-back of the thermally highly loaded trailing edge, the narrow passage cross-section then effective also remains approximately constant. It is thereby ensured that the flow rate remains similar even in the case of burn-back. An embodiment of this type is known for example from FIG. 4 of DE 10 2005 025 213 A1.

The disadvantage of the stator wheel designs known from the state of the art is that the aerodynamic design cannot be made loss-optimized, since the generally advantageous design with heavy aerodynamic loading in the rear suction-side area ("Rear-Loaded-Design") greatly infringes the burn-back criterion. It is therefore always necessary to compromise in the aerodynamic design so that the burn-back capability is ensured. This in turn reduces the turbine efficiency and increases the specific fuel consumption (SFC) of the turbomachine.

SUMMARY

An object underlying the present invention is to provide a turbine stator wheel of the type specified at the beginning, which while being simply designed and simply structured, has a high efficiency and at the same time ensures the above mentioned burn-back criterion. In the event of a burn-back in particular, the turbine capacity should remain largely unchanged, so that the overall engine with its individual components can continue to be operated at the design point.

It is a particular object of the present invention to provide solution to the above problems by a combination of features as described herein.

Accordingly, the solution in accordance with the invention considers a turbine stator wheel in which two adjacent stator vanes each form a passage including a constant passage portion. This constant passage portion is characterized in that it has a substantially constant passage cross-section. The constant passage portion has an inlet area into said constant passage portion and an outlet area. The outlet area is located at the vane trailing edge and is as a rule identical to the narrowest cross-section (narrow cross-section) of the passage. Each stator vane forms on the pressure side a rear area which extends from the vane trailing edge adjoining the constant passage portion as far as the inlet area of the passage portion, and a front area extending upstream of the rear area. The rear area is thus that area of the pressure side of the stator vane that delimits the constant passage portion.

It is provided in accordance with the invention that the stator vanes have a convex pressure-side contour on the pressure side which provides a transition from the rear area of the stator vane to the front area of the stator vane.

The solution in accordance with the invention provides a convex pressure-side contour on the pressure side of the stator vane such that due to said convex pressure-side contour a transition is made from a rear area of the stator vane, in which a constant passage portion is present, to a front area of the stator vane. The rear area of the stator vane is thus connected to the front area of the stator vane via the convex pressure-side contour.

The convex pressure-side contour, or the convex curvature of the pressure side provided by this contour, enables the passage between two stator vanes to be designed constant over a certain length, even if the adjacent stator vane is, in order to obtain a loss-optimized turbine stator wheel, provided on the suction side with a considerably convex curvature which—without compensation by the convex pressure-side contour—would lead to a considerable widening of the passage. The invention thus ensures a burn-back capability even in the event that a loss-optimized turbine stator wheel is provided that has stator vanes with a considerably convex curvature of the suction side in the area of the narrow cross-section.

Whereas in designs known in the state of the art the walls of the suction side and of the pressure side adjoining the vane trailing edge are designed substantially straight or with an even curvature and thus form a wedge-shaped cross-sectional area of the stator vane, the solution in accordance with the invention thus provides that the wall of the pressure side of the stator vane forms a convex pressure-side contour, i.e. a convex curvature, which forms the transition between the rear area of the stator vane adjoining the constant passage portion and the front area extending upstream from it.

The invention ensures the burn-back capability, due to convex contouring of the pressure side of the stator vane of the stator wheel, without the aerodynamic design of the suction side of the stator vane being affected. It is thus possible in accordance with the invention to freely define the suction side of the stator vane of the stator wheel and design it loss-optimized while achieving stator vanes with a considerably convex curvature of the suction side in the area of the narrow cross-section or adjacent to the narrow cross-section. It is ensured by the embodiment in accordance with the invention of the pressure-side contour of the stator vane that in the event of burn-back the cross-section of the passage between adjacent stator vanes remains substantially constant, so that the flow rate (capacity) of the turbine and hence the efficiency of the overall engine are affected not at all or only to a minor extent by a burn-back.

According to an embodiment of the invention, it is provided that the profile thickness of the stator vanes rises or is constant or decreases to a lesser extent in the direction of the vane trailing edge upstream of the rear area of the stator vanes than in the rear area of the stator vane. In other words, this embodiment provides that the profile thickness rises or is constant or decreases to a lesser extent in the direction of the vane trailing edge upstream of the inlet area into the passage than in the area of the constant passage portion. This corresponds to the design of the convex pressure-side contour on the pressure side of the stator vane, which is precisely what ensures that the profile thickness of the stator vanes rises, is substantially constant or decreases only slightly upstream of the constant passage portion when compared with a subsequently sharper decrease of the profile thickness in the rear area of the stator vane up to the vane trailing edge.

According to a further embodiment of the invention, it is provided that the convex pressure-side contour at or upstream of the inlet area into the constant passage cross-section forms a maximum. It can further be provided that the convex pressure-side contour at or upstream of the inlet area into the constant passage cross-section forms a maximum in the curvature. The maximum in the curvature is here close to the point locally projecting furthest from the pressure side or close to the line of the pressure-side contour locally projecting furthest from the pressure side. The maximum and/or the maximum in the curvature are thus located not in the rear area of the stator vane, but in the front area of the stator vane, however preferably at a short distance from the rear area (e.g. at a distance corresponding to a maximum of 10% of the length of the skeleton line) or directly at the transition of the two areas.

A further embodiment of the invention provides that the convex pressure-side contour on the pressure side of the stator vanes is formed predominantly or completely in the front area of the stator vane. It can be provided here that part of the convex pressure-side contour is additionally formed in the rear area of the stator vane. Generally speaking, a straight or even a concave curvature merging into the convex pressure-side contour can however also be provided in the rear area of the stator vane that delimits the constant passage portion.

In the meaning of the present invention, a substantially constant passage cross-section is present for example when the passage cross-section diverges no more than 20% from the narrow cross-section in the area of the vane trailing edge. This divergence from the narrow cross-section is preferably lower, and less than 10%, 5% or 2% of the narrow cross-section. Ideally, the passage cross-section in the constant passage portion is exactly constant. It can further be provided that the constant passage portion extends over a chord length which is for example in a range between 5% and 40% of the total chord length and is for example approximately 5%, 10%, 15%, 20%, 25%, 30%, 35% or 40% of the total chord length.

Generally speaking, it can be provided that the convex pressure-side contour extends over the entire height of the stator vane. It can furthermore be provided that the pressure-side contour extends at least over a partial area of the vane height (for example over at least 50% or at least 70% of the vane height). It is furthermore possible for the design of the curvature to vary over the vane height.

It is particularly favourable when the stator vane, starting from the vane trailing edge, is provided with a concave area adjoining the convex area. This embodiment leads in particular to an optimum surface pressure distribution on the vane surface.

In accordance with the invention the following advantages are achieved:

In accordance with the invention there is an increase in the aerodynamic efficiency, since compared with an embodiment of the stator vanes according to the state of the art an increase in the stage efficiency is achieved.

A further advantage results with regard to mechanical stability. The convex pressure-side contour of the stator vane results, when compared with the state of the art, in a substantially higher wedge angle adjoining the vane trailing edge. Hence the profile in the trailing edge area is thicker. This in turn leads to an increased mechanical stability, which results in a far lower deformation of the trailing edge under thermal load in operation.

The turbine stator wheel in accordance with the invention has considerable advantages with regard to cooling air consumption too. Since the vane contour has a greater thickness in the trailing edge area, it is possible to extend the internal cooling geometry further in the direction of the vane trailing edge. This can for example be achieved by so-called pedestal banks positioned further back. This results in the possibility of saving on cooling air, since the trailing edge overhang that is difficult to cool and subjected to the highest thermal load can be reduced in length.

Due to the mechanically more stable and easier to cool trailing edge area, a longer service life results from the embodiment in accordance with the invention of the cross-section of the stator vanes.

A further advantage is achieved with regard to the stability of the engine characteristics and to turbine efficiency in long-term operation. The engine flow rate changes less strongly in long-term operation due to the more stable and easier to cool vane trailing edge. The drop in high-pressure turbine efficiency due to the rise in trailing edge losses as a result of burn-back is reduced.

A further substantial advantage results from cost savings due to the longer service life and due to reduced engine development costs. The engine development costs can be reduced due to the reliable capacity forecast, since the necessity for subsequent capacity change is reduced. The engine development time too can be shortened.

BRIEF DESCRIPTION OF THE DRAWINGS

The present invention is described in the following in light of the accompanying drawing, showing exemplary embodiments.

Figure 4:
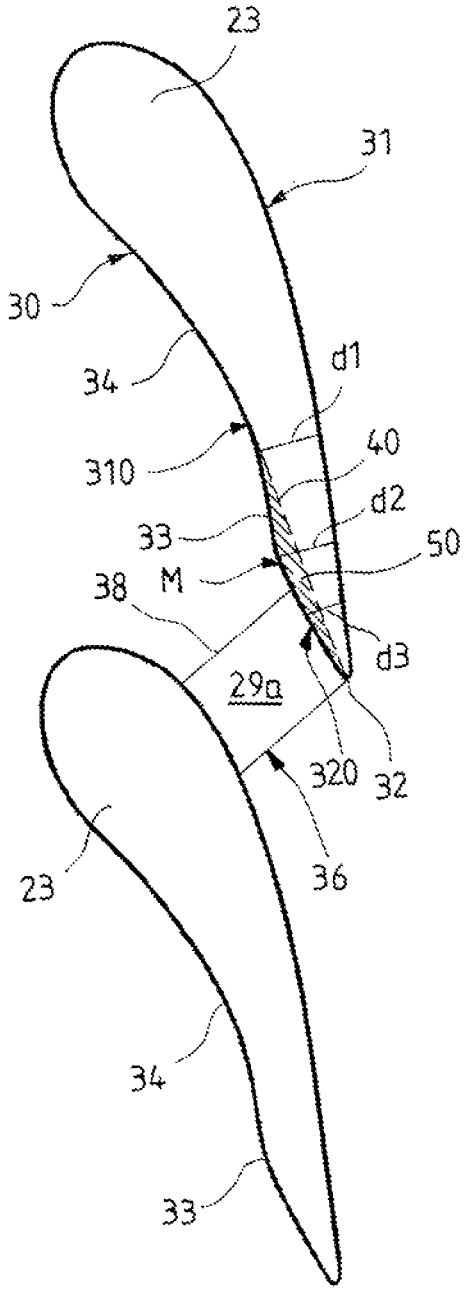
FIG. 4 shows a view of a second exemplary embodiment in accordance with the present invention.

and the exemplary embodiment in accordance with the invention of FIG. 4 (right-hand half of figure).

Figure 5:
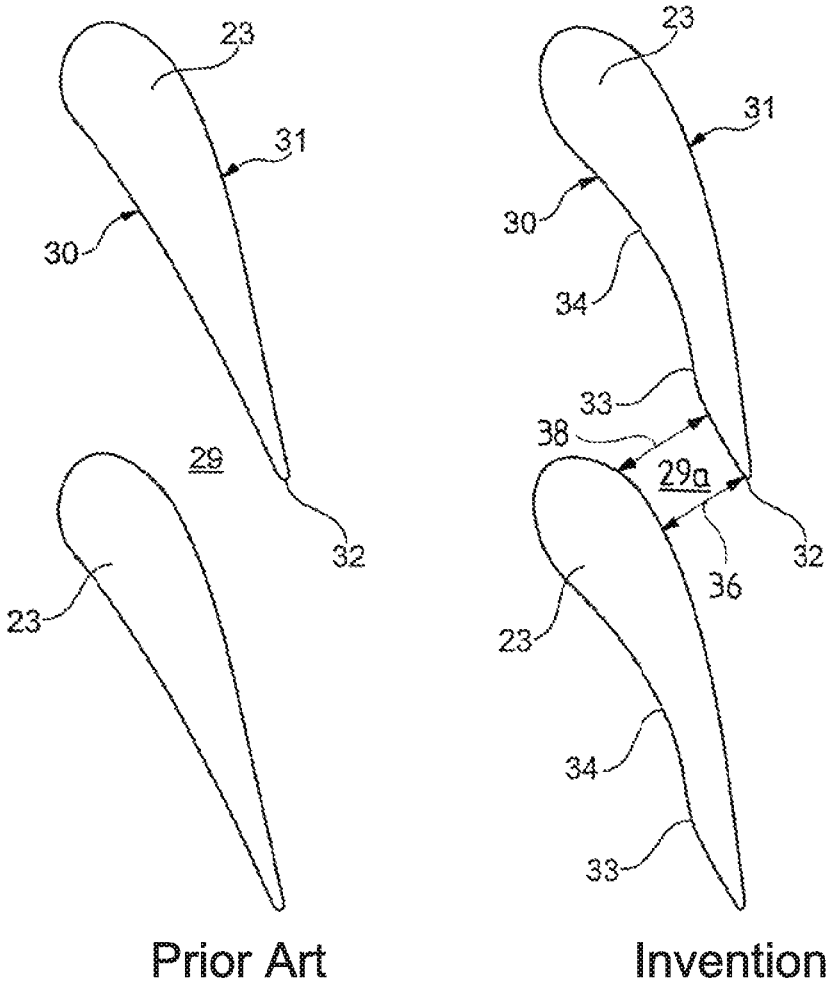
FIG. 5 shows a comparative view of the embodiment in accordance with the state of the art (left-hand half of figure)
Figure 6:
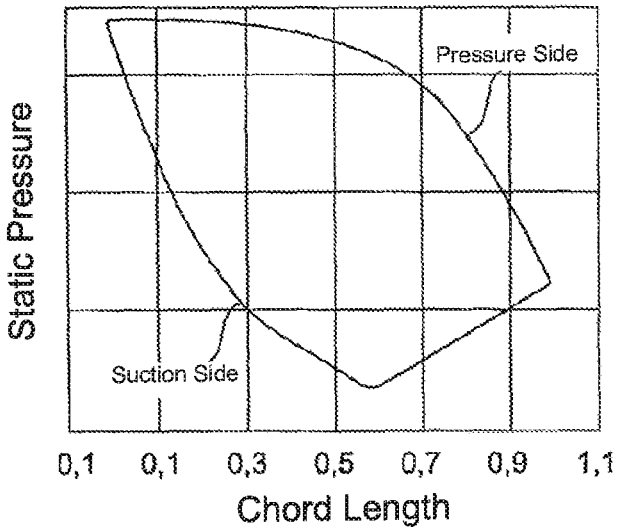
Figure 6:
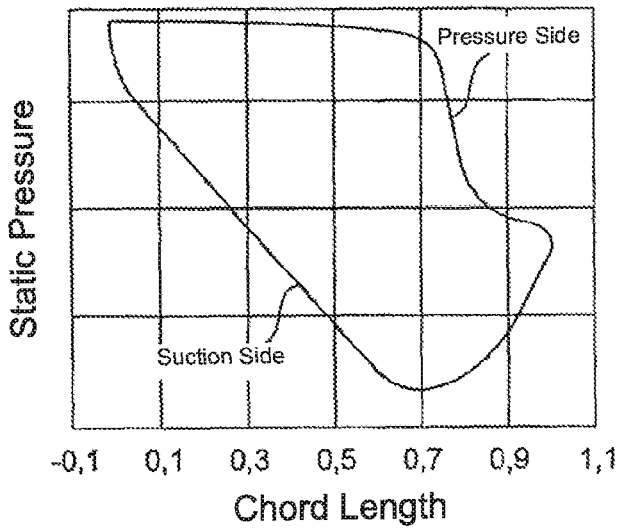

FIG. 6 shows in the upper half of the figure the static surface pressures of the embodiment in accordance with the state of the art (as per FIG. 5, left-hand side) and in the lower half of the figure the static surface pressures of the embodiment according to an exemplary embodiment in accordance with the invention (as per FIG. 5, right-hand side).

DETAILED DESCRIPTION

Figure 1:
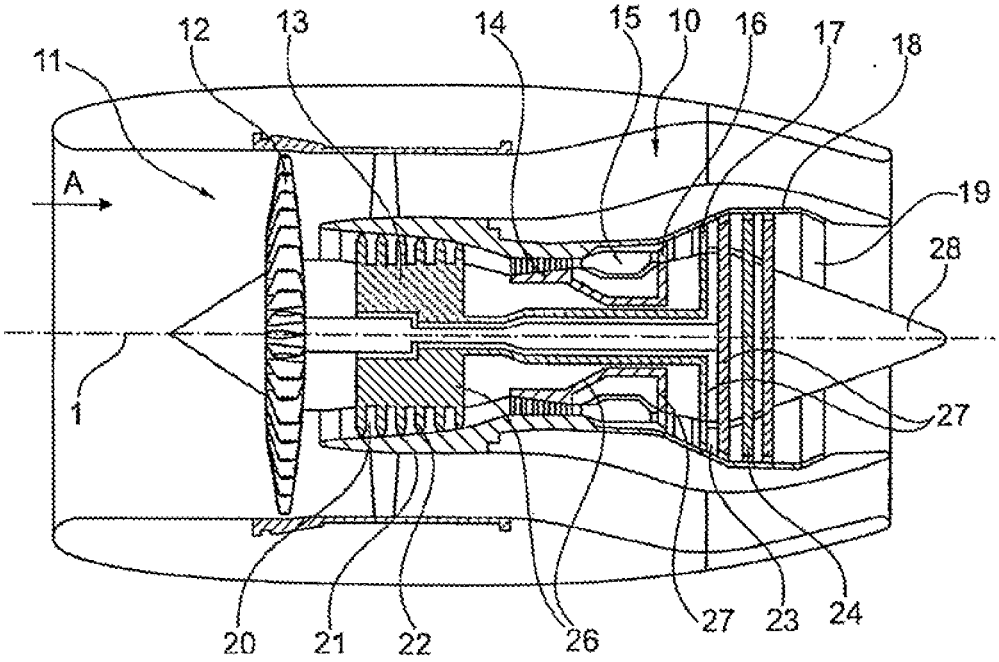
FIG. 1 shows a schematic representation of a gas-turbine engine in accordance with the present invention.

The gas-turbine engine 10 in accordance with FIG. 1 is a generally represented example of a turbomachine where the invention can be used. The engine 10 is of conventional design and includes in the flow direction, one behind the other, an air inlet 11, a fan 12 rotating inside a casing, an intermediate-pressure compressor 13, a high-pressure compressor 14, a combustion chamber 15, a high-pressure turbine 16, an intermediate-pressure turbine 17 and a low-pressure turbine 18 as well as an exhaust nozzle 19, all of which being arranged about a center engine axis 1.

The intermediate-pressure compressor 13 and the high-pressure compressor 14 each include several stages, of which each has an arrangement extending in the circumferential direction of fixed and stationary guide vanes 20, generally referred to as stator vanes and projecting radially inwards from the core engine casing 21 in an annular flow duct through the compressors 13, 14. The compressors furthermore have an arrangement of compressor rotor blades 22 which project radially outwards from a rotatable drum or disk 26 linked to hubs 27 of the high-pressure turbine 16 or the intermediate-pressure turbine 17, respectively.

The turbine sections 16, 17, 18 have similar stages, including an arrangement of fixed stator vanes 23 projecting radially inwards from the casing 21 into the annular flow duct through the turbines 16, 17, 18, and a subsequent arrangement of turbine rotor blades 24 projecting outwards from a rotatable hub 27. The compressor drum or compressor disk 26 and the blades 22 arranged thereon, as well as the turbine rotor hub 27 and the turbine rotor blades 24 arranged thereon rotate about the engine axis 1 during operation.

Figure 2:
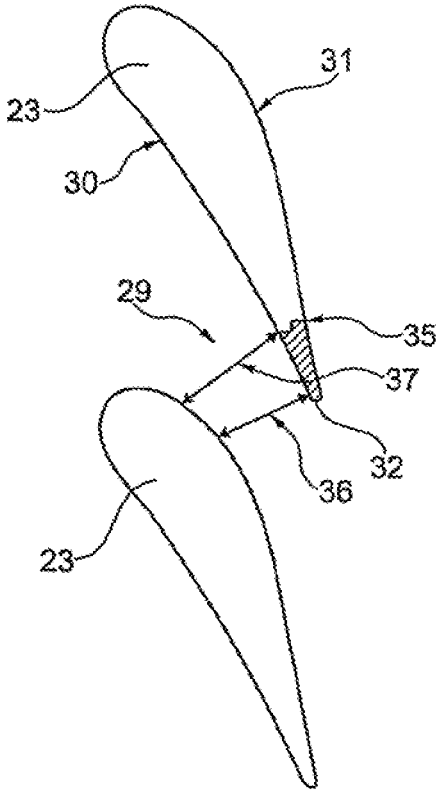
Fig. 2 Prior Art
FIG. 2 shows a partial view of a turbine stator wheel in accordance with the state of the art.

FIG. 2 shows a view of a turbine stator wheel known from the state of the art when viewing the front sides of adjacent stator vanes 23, which each have a pressure side 30 and a suction side 31 and form a passage 29 through which flow the hot gases exiting the combustion chamber. FIG. 2 shows that in the area of a vane trailing edge 32 the passage 29 has a narrowest cross-section (narrow cross-section 36) which is formed to match the required profile shape of the stator vanes 23. The thermal load during operation results in a burning off of the area of the vane trailing edge 32, so that a burn-back 35 results. This means that the hatched surface of the vane profile burns off. This results in an effective passage cross-section 37 which is considerably wider compared with the narrow cross-section 36 and consequently leads to a marked reduction in efficiency. The widening of the passage cross-section is accompanied by a change in flow rate and capacity.

The problem described is all the greater the more the turbine stator wheel is designed as a loss-optimized turbine stator wheel and to do so has stator vanes 23 which are provided on the suction side 31 in the area of the narrow cross-section 36 or adjoining the narrow cross-section 36 with a considerably convex curvature, which in the case of a burn-back leads to a considerable widening of the passage.

Figure 3:
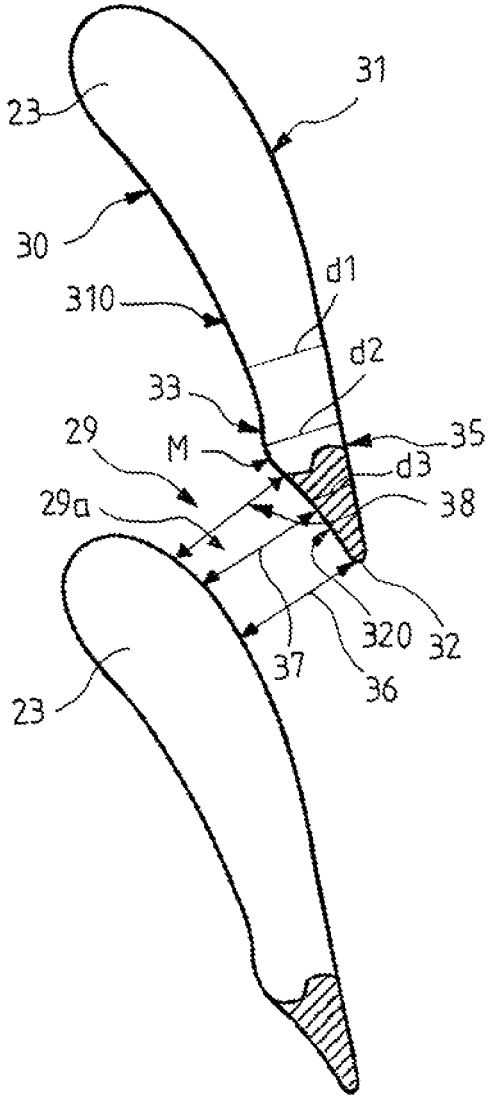
FIG. 3 shows a view of a first exemplary embodiment in accordance with the present invention.

FIG. 3 shows a view of an exemplary embodiment in accordance with the invention. The stator vanes 23 have in turn a pressure side 30 and a suction side 31, where two adjacent stator vanes 23 form a passage 29 between the suction side 31 of the one stator vane and the pressure side 30 of the other stator vane starting from the vane trailing edge 32 through which passage 29 flow the hot gases exiting the combustion chamber. It is provided here that the passage 29 includes a constant passage portion **29*a* in which the passage 29 has a substantially constant passage cross-section 37**.

The constant passage portion **29*a* has an inlet area 38 and an outlet area 36 which have substantially the same passage cross-section. The outlet area 36 is delimited here by the vane trailing edge 32, so that the outlet area 36 matches the narrow cross-section of the passage 29**.

The statement that the passage cross-section 37 in the constant passage portion **29*a* is substantially constant means that the divergence of the passage cross-section 37 from the narrow cross-section in this constant passage portion 29*a* is less than a defined value, which is for example defined as 20% of the narrow cross-section. Alternatively, a constant passage cross-section 29*a*** can for example be defined in that the divergence from the narrow cross-section is less than 15%, 10% or 5% of the narrow cross-section.

The stator vane 23 furthermore forms on the pressure side a rear area 320 that extends, starting from the vane trailing edge 32 adjoining the constant passage portion **29*a* as far as the inlet area 38 of the constant passage portion 29*a*. The pressure-side rear area 320 of the stator vane is therefore that area which delimits the constant passage portion 29*a* on the pressure side. Upstream of the rear area 320 a front area 310 extends generally speaking as far as the vane leading edge, but for the purposes of the present invention only that part of the front area adjoining the rear area 320** is considered in detail.

The stator vane 23 furthermore has on the pressure side 30 a convex pressure-side contour 33 creating a transition from the rear area 320 to the front area 310. This means that the convex pressure-side contour 33 is provided in the transition area between the two areas 310 and 320, and can extend exclusively in the front area 310 or alternatively over both areas 310, 320. The convex pressure-side contour 33 has a maximum M, which in the cross-sectional view of FIG. 3 indicates the point at which the curvature provided by the convex pressure-side contour 33 projects locally furthest from the pressure side 30.

Accompanying the convex pressure-side contour 33 is a certain course of the profile thickness d of the stator vane 23. If the course of the profile thickness d in the direction of the vane trailing edge 32 is viewed, the situation is such that the profile thickness d upstream of the rear area 320 (or upstream of the inlet area 38) rises or is constant, as is illustrated by the profile thicknesses d1 and d2 of FIG. 3. In the rear area 320 of the stator vane, by contrast, the profile thickness d drops relatively sharply, as shown by way of example by the profile thickness d3. Alternatively, it can also be provided that the profile thickness upstream of the rear area 320 does not rise or is constant, however decreases only to a lesser extent (i.e. by a smaller value per unit of length) than in the rear area 320. This course of the profile thickness d corresponds to the provision of a maximum M for the curvature provided by the convex pressure-side contour 33 upstream of or at the inlet area into the constant passage portion **29*a***.

The provision of a convex pressure-side contour 33 leads on the one hand to an increase of the wedge angle between the surfaces of the pressure side 30 and the suction side 31 in the area adjoining the vane trailing edge 32, and in particular to an avoidance of any widening of the passage cross-section in the event of burn-back. This widening is prevented precisely because the solution in accordance with the invention provides a constant passage portion 29*a*, so that the narrow cross-section does not change in the event of burn-back 35 in the area of this constant passage portion 29*a*. A burn-back 35 is drawn heavily exaggerated in FIG. 3 in order to better explain the effectiveness of the invention. The result is that the passage cross-section 37 inside the constant passage portion 29*a* remains substantially the same in the event of burn-back, since the narrow cross-section 36 in this portion is substantially equal to the passage cross-section 37.

FIG. 4 shows a further exemplary embodiment in accordance with the invention of two stator vanes 23 of a turbine stator wheel. Generally speaking, the exemplary embodiment matches the embodiment of FIG. 3, to which reference is made with regard to the reference numerals used. It is in turn provided that by the provision of a convex pressure-side contour 33 on the pressure side 30 of the stator vane 23, the rear area 320 of the stator vane 23 is given a shape that permits the provision of a constant passage portion 29*a* with substantially constant passage cross-section 37 between an inlet area 38 and an outlet area 36 of this constant passage portion 29*a*.

The corresponding curvature of the convex pressure-side contour 33 leads to the profile thickness d of the stator vane 23 rising or remaining substantially constant upstream of the rear area 320 and decreasing sharply only in the rear area 320 of the stator vane (cf. profile thicknesses d1, d2 and d3 in FIG. 4).

One difference in the embodiment of FIG. 4 from the embodiment of FIG. 3 is in the curvature of the pressure side 30 of the stator vane in the rear area 320. Whereas this curvature in FIG. 3 is designed at least approximately concave, it is in the exemplary embodiment of FIG. 4 designed convex, so that the rear area 320 forms a partial area of the convex pressure-side contour 33 and contributes to the latter. The maximum M of the convex pressure-side contour 33 is located however upstream of the constant passage portion 29*a* in the front area 310. The convex pressure-side contour 33 here forms the transition from the rear area 320 of the stator vane to the front area 310 of the stator vane.

FIG. 4 furthermore shows an additional line 40 and an additional surface 50 which are not actually present in the stator vane 23 and serve only to make the solution in accordance with the invention more clear. The line 40 thus indicates the course of the pressure side of a stator vane designed according to the state of the art, where the wall of the stator vane 23 adjoining the vane trailing edge 32 is designed substantially straight or with a slight and even curvature. The line 40 thus makes clear the pressure-side contour of a conventional stator vane. The surface 50 makes clear a thickening achieved by providing a convex pressure-side contour 33. By this thickening or provision of a convex pressure-side contour 33 it is possible, even with a loss-optimized turbine stator wheel that has stator vanes 23 with a considerably convex curvature of the suction side 31 in the area of the narrow cross-section and/or adjacent to the narrow cross-section, to provide a constant passage portion 29*a* inside the passage 29, so that in the event of a burn-back 35 widening of the passage is prevented.

A thickening 50 is also present in the exemplary embodiment of FIG. 3, but has in the exemplary embodiment of FIG. 3 a different shape and is not convex overall, but also has a convex portion in the transition from the rear area 320 to the front area 310. In the embodiment of FIG. 4, the thickening 50 is formed completely by the convex pressure-side contour 33.

A further feature specific to the embodiment of FIG. 4 is that a concave area 34 is provided adjoining the convex area 33 on the pressure side 30 of the stator vane 23. This leads to a further optimization of the surface pressure distribution on the vane surface.

FIG. 5 shows a comparison of the embodiment according to the state of the art as shown in FIG. 2 (left-hand half of FIG. 5) and an exemplary embodiment of the invention according to FIG. 4. The contouring of the pressure side 30 provided in accordance with the invention results in the advantages described above. This is also evident in particular from the comparative representation of the static surface pressures according to FIG. 6, where the standardized chord length of 0.0 corresponds to the position of the vane leading edge and the standardized chord length of 1.0 to the position of the vane trailing edge.

The upper half of FIG. 6 shows the surface pressure distribution associated with the geometric embodiment according to the state of the art (FIG. 5 left-hand side). The lower half of FIG. 6 shows the surface distribution associated with the embodiment in accordance with the invention (FIG. 5 right-hand side). Discernible is the advantageous pressure course resulting in accordance with the invention on the suction side (FIG. 6 bottom) and implementable without infringement of the burn-back criterion. The S-shape of the pressure course on the pressure side in the area of the vane trailing edge for the chord length 0.7 to 1.0 (FIG. 6 bottom) results from the contouring of the pressure side in accordance with the invention to ensure the burn-back criterion.

LIST OF REFERENCE NUMERALS

1 Engine axis
10 Gas-turbine engine/core engine
11 Air inlet
12 Fan
13 Intermediate-pressure compressor
14 High-pressure compressor
15 Combustion chamber
16 High-pressure turbine
17 Intermediate-pressure turbine
18 Low-pressure turbine
19 Exhaust nozzle
20 Guide vanes
21 Core engine casing
22 Compressor rotor blades
23 Turbine stator vanes
24 Turbine rotor blades
26 Compressor drum or disk
27 Turbine rotor hub
28 Exhaust cone
29 Passage
29*a* Constant passage portion
30 Pressure side
310 Front pressure-side area of pressure side
320 Rear pressure-side area of pressure side
31 Suction side
32 Vane trailing edge
33 Convex pressure-side contour/convex area
34 Concave area
35 Burn-back
36 Narrow cross-section/passage outlet area
37 Passage cross-section

38 Passage inlet area
40 Course of conventional stator vane wall
50 Thickening
d Profile thickness
M Maximum of convex pressure-side contour

What is claimed is:

1. A gas turbine engine, comprising:
a compressor;
a combustion chamber;
a turbine including a turbine stator wheel positioned downstream of the combustion chamber to receive hot gases exiting the combustion chamber; the turbine stator wheel comprising:
a plurality of stator vanes spaced apart around a circumference of the turbine stator wheel, wherein
each of the plurality of stator vanes including a suction side, a pressure side and a vane trailing edge,
each two adjacent stator vanes of the plurality of stator vanes form a passage each between a suction side of a first one of the two adjacent stator vanes and a pressure side of a second one of the two adjacent stator vanes starting from a vane trailing edge of the second one of the two adjacent stator vanes, the passage including a constant passage portion in which the passage has a substantially constant passage cross-section, wherein the substantially constant passage cross-section is present when a cross-section of the passage diverges no more than 5% from a narrowest cross-section of the passage in an area of the vane trailing edge,
the constant passage portion includes an inlet area and an outlet area,
each of the plurality of stator vanes includes on the pressure side a rear area that extends, starting from the vane trailing edge adjoining the constant passage portion as far as the inlet area of the constant passage portion, and a front area that extends upstream of the rear area, and
each of the plurality of stator vanes includes on the pressure side a convex pressure-side contour creating a transition from the rear area of the stator vane to the front area of the stator vane.

2. The gas turbine engine in accordance with claim 1, wherein a profile thickness of at least a portion of each of the plurality of stator vanes upstream of the rear area increases.

3. The gas turbine engine in accordance with claim 1, wherein the convex pressure-side contour is at a maximum at or upstream of the inlet area.

4. The gas turbine engine in accordance with claim 1, wherein the convex pressure-side contour is formed predominantly or completely in the front area.

5. The gas turbine engine in accordance with claim 1, wherein a portion of the convex pressure-side contour is formed in the rear area.

6. The gas turbine engine in accordance with claim 1, wherein each of the plurality of stator vanes includes a concave area between the vane trailing edge and the convex pressure-side contour.

7. The gas turbine engine in accordance with claim 1, wherein the convex pressure-side contour extends at least over a partial area of a vane height.

8. The gas turbine engine in accordance with claim 1, wherein the turbine stator wheel is rear loaded and wherein each of the plurality of stator vanes includes a considerably convex curvature on the suction side in an area of the narrowest cross-section of the passage.

9. The gas turbine engine in accordance with claim 1, wherein the turbine stator wheel is a high-pressure turbine stator wheel.

10. The gas turbine engine in accordance with claim 1, wherein a profile thickness of at least a portion of each of the plurality of stator vanes upstream of the rear area is constant.

11. The gas turbine engine in accordance with claim 1, wherein a profile thickness of at least a portion of the plurality of stator vanes upstream of the rear area decreases to a lesser extent than in the rear area.

12. The gas turbine engine in accordance with claim 1, wherein the turbine stator wheel is rear loaded and wherein each of the plurality of stator vanes includes a considerably convex curvature on the suction side in an area adjoining the narrowest cross-section of the passage.

* * * * *